US005317817A

United States Patent [19]

Roberts et al.

[11] Patent Number: 5,317,817

[45] Date of Patent: Jun. 7, 1994

[54] TRAILING SHEET ASSEMBLY FOR AN AIR TURN

[75] Inventors: H. Noel Roberts, Greenbay; Kenneth N. Jenquin, Kellnersville; Richard M. Perock, DePere, all of Wis.

[73] Assignee: W.R. Grace & Co.-Conn., New York, N.Y.

[21] Appl. No.: 876,599

[22] Filed: Apr. 30, 1992

[51] Int. Cl.[5] ..... F26B 13/00

[52] U.S. Cl. ..... 34/642; 34/120; 34/117; 226/97

[58] Field of Search ..... 34/155, 156, 120, 117, 34/23; 226/7, 97

[56] References Cited

U.S. PATENT DOCUMENTS

| | | | |
|---|---|---|---|
| 3,127,080 | 3/1964 | Allander et al. | 226/97 |
| 3,485,429 | 12/1969 | Hutzenlaub | 34/156 |
| 3,964,656 | 6/1976 | Hella | 226/97 |
| 4,186,860 | 2/1980 | Reba | 226/91 |
| 4,197,971 | 4/1980 | Stibbe | 226/97 |
| 4,218,833 | 8/1980 | Coar | 34/156 |
| 4,809,445 | 3/1989 | Meyer et al. | 34/117 |
| 4,837,946 | 6/1989 | Hella et al. | 34/156 |
| 4,848,633 | 7/1989 | Hagen et al. | 34/156 |

FOREIGN PATENT DOCUMENTS

| | | | |
|---|---|---|---|
| 0032875 | 7/1981 | European Pat. Off. . | |
| 2610956 | 9/1977 | Fed. Rep. of Germany . | |
| 3706541 | 9/1988 | Fed. Rep. of Germany . | |
| 2126974 | 9/1985 | United Kingdom | B65H 23/32 |

OTHER PUBLICATIONS

Circular Flotation Dryer Eliminates Picking, Tec Systems Air Can, 1980.

*Primary Examiner*—Henry A. Bennet
*Assistant Examiner*—Denise L. Gromada
*Attorney, Agent, or Firm*—Kevin S. Lemack; William L. Baker

[57] ABSTRACT

Disclosed is an air turn for supporting and optionally drying a web, the air turn comprising a plurality of air bars having a wing type foil with an adjustable web-to-foil gap and multiple relief holes. The apparatus of the invention allows for the ability to control the air vortex off the lower air turn in an air turn array and to control the pressure between the web and foil, thereby eliminating web flutter.

5 Claims, 17 Drawing Sheets

TRAILING SHEET ASSEMBLY FOR AN AIR TURN

FIELD OF THE INVENTION

The present invention relates to devices for contactlessly drying and guiding traveling webs, and more particularly, an improved air flotation device which minimizes or eliminates web flutter.

BACKGROUND OF THE INVENTION

In web printing and drying operations, it is often desirable that the web be contactlessly supported, in order to avoid damage to the web itself or to the coating (such as ink) previously applied to one or more surfaces of the web. One conventional arrangement for contactlessly supporting a web includes horizontal upper and lower sets of air bars between which the web travels. Hot air issuing from the air bars both dries and supports the web. Occasionally it becomes necessary to change the direction of web travel while maintaining the contactless environment. This can be accomplished using air turns, which are devices that support a flexible web on a cushion of air pressure as the web travels around a curved path. Air turns such as the Tecturn ®, commercially available from W. R. Grace & Co.-Conn., accomplishes web guidance without regard to any web drying function.

GB 2 126 974B (the disclosure of which is hereby incorporated by reference) discloses a device for contactlessly supporting a moving web by guiding the same around a turn, whereby a substantial amount of web drying is also accomplished. To that end, the device disclosed includes a plurality of elongate air bars, each having opposite side walls, and a front wall that is located between the side walls and has opposite longitudinally extending edge portions which are spaced from the side walls to cooperate with them in defining a pair of air outlet slots, each extending along the length of the air bar, the edge portions of the front wall being curved widthwise towards the middle of the air bar so that each of the outlet slots comprises a Coanda type nozzle for directing pressurized air forwardly from the interior of the air bar and laterally across the from wall toward the other outlet slot. A plenum chamber communicates with a source of pressurized air, and is also in communication with the inside of each air bar. The air bars are arranged such that they lie substantially in a convex arc. Thus, such devices or combine the features of an air turn and a flotation dryer. The air bars making up the air turn support the web without contact on a cushion of air while the web follows a circular path and is simultaneously heated and dried. Air turns of this type are often combined with straight path flotation systems, or a plurality of such air turns can be used to create an "S" shaped web path. As shown in U.S. Pat. No. 4,218,833 (the disclosure of which is hereby incorporated by reference), such air turns can be arranged with adjacent arrays inverted in relation to each other so as to support the traveling web in a circuitous path around such arrays.

An important aspect of any flotation system is the stability of the web as it passes over an air bar. Airflow instabilities near the web can induce web flutter and subsequent web contact with mechanical parts of the drying, resulting in coating disturbance or web damage. Web flutter can be manifested in a multitude of forms, ranging from a violent flapping of the web to a high frequency drumming.

Excessive web flutter has been encountered in air turn applications. Where a plurality of air turns are used together so that the web follows a sinusoidal path, web flutter has been encountered as the web leaves the lower air turn and before it reaches the upper air turn. It is believed that such web flutter may be due to distance between turns; the spent air from the lower turn influences the web to follow the turn diameter, while the upper turn pushes the web out to maintain web flotation. In particular, it is believed that the cause of the fluttering is related to the angle of the lower turn being greater than 90°. The exhausted air from the turn face apparently exits upward with the web sheet and is peeling off away from the bottom of the web sheet face, causing vortices.

It is therefore an object of the present invention to minimize or eliminate web flutter in air turn applications.

SUMMARY OF THE INVENTION

The problems of the prior art have been solved by the present invention, which provides an air turn for supporting and optionally drying a web, the air turn comprising a plurality of air bars having a wing type foil with an adjustable web-to-foil gap and multiple relief holes. The apparatus of the invention allows for the ability to control the air vortex off the lower air turn in an air array and to control the pressure between the web and foil, thereby eliminating web flutter.

DETAILED DESCRIPTION OF THE INVENTION

Figure 1:
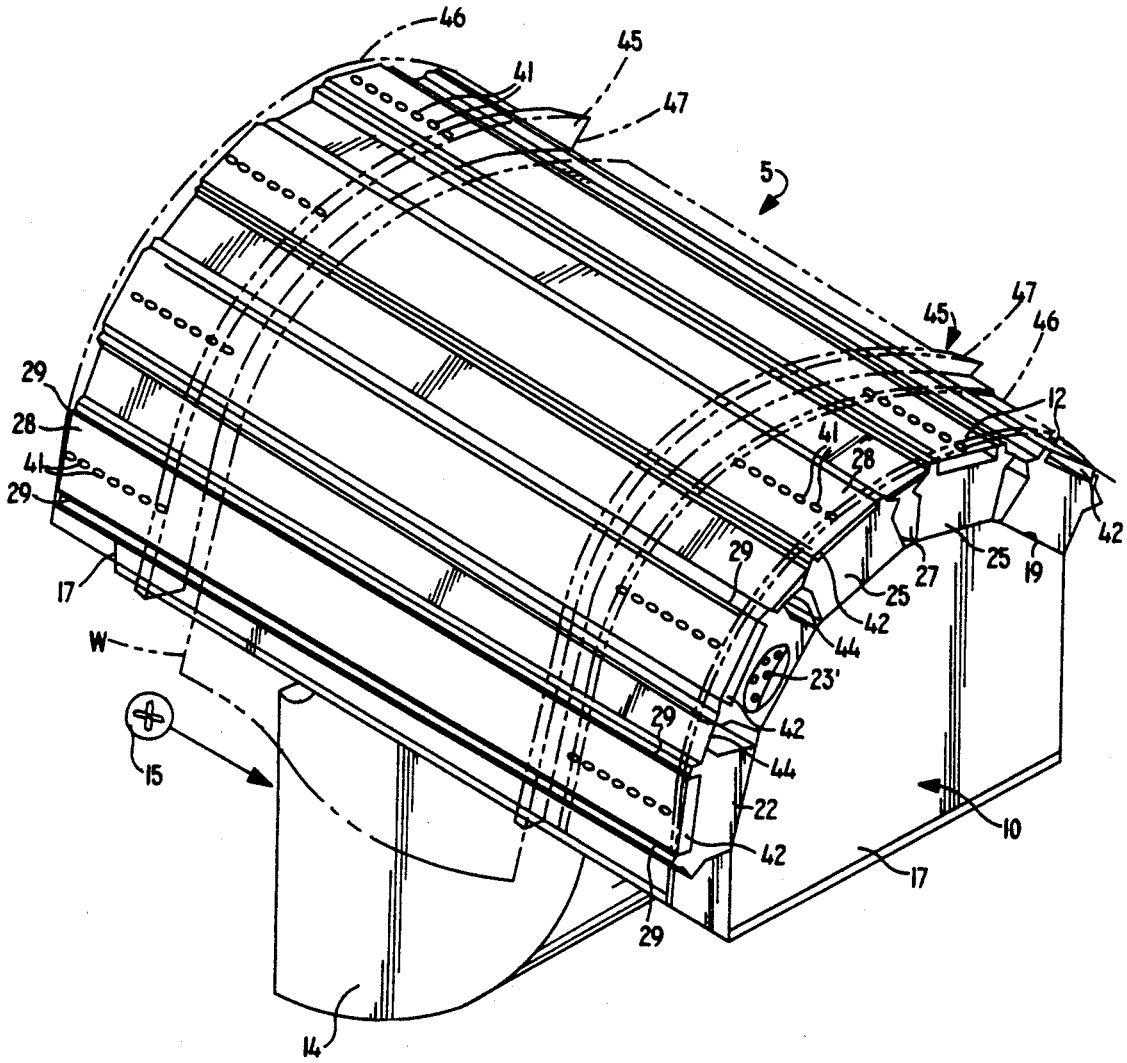
FIG. 1 (PRIOR ART)
FIG. 1 is a perspective view of a conventional air turn which can be used in accordance with the instant invention.
Figure 2:
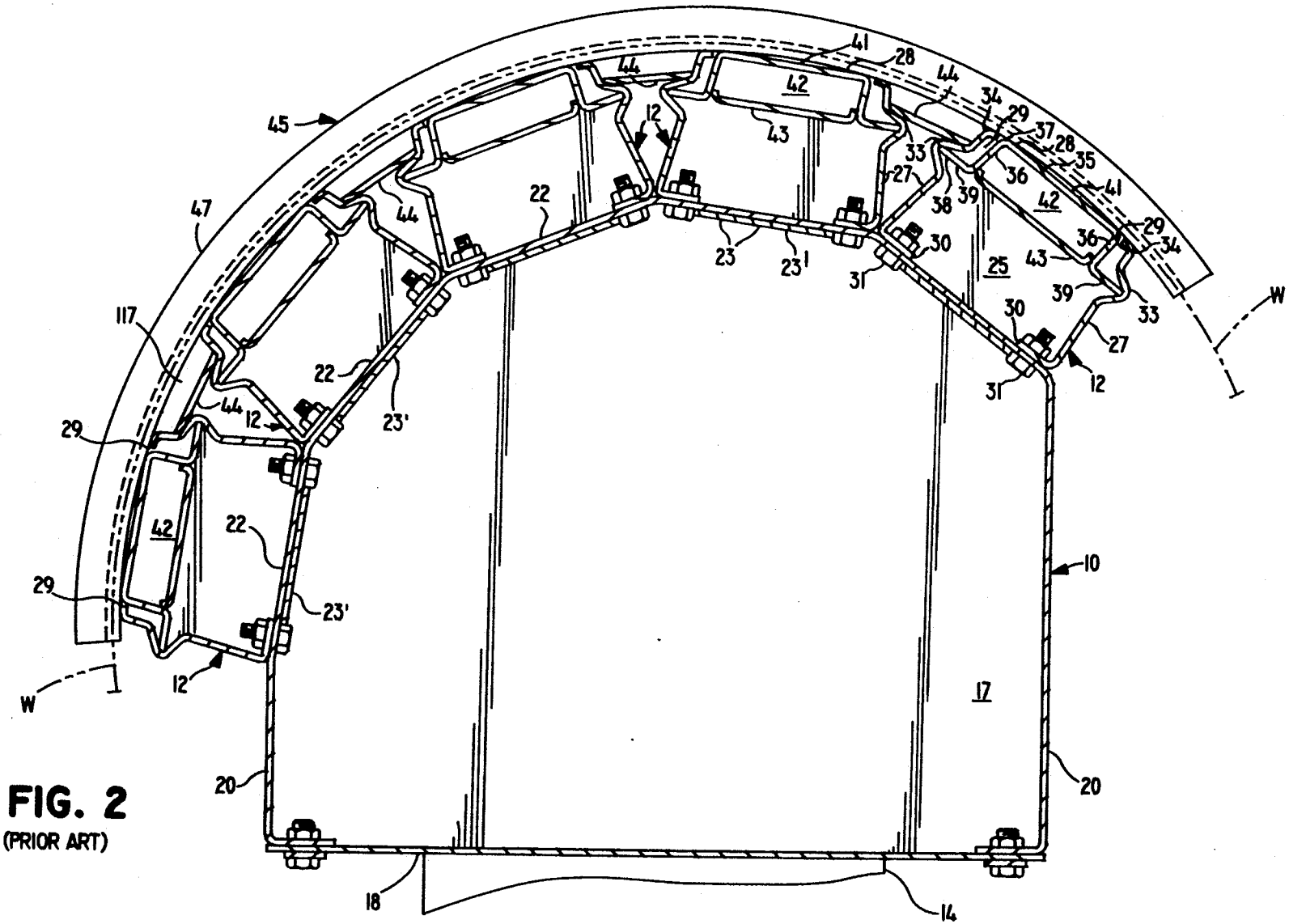
FIG. 2 (PRIOR ART)
FIG. 2 is a vertical section of the conventional air turn of FIG. 1 taken on a plane parallel to its end walls.
Figure 3:
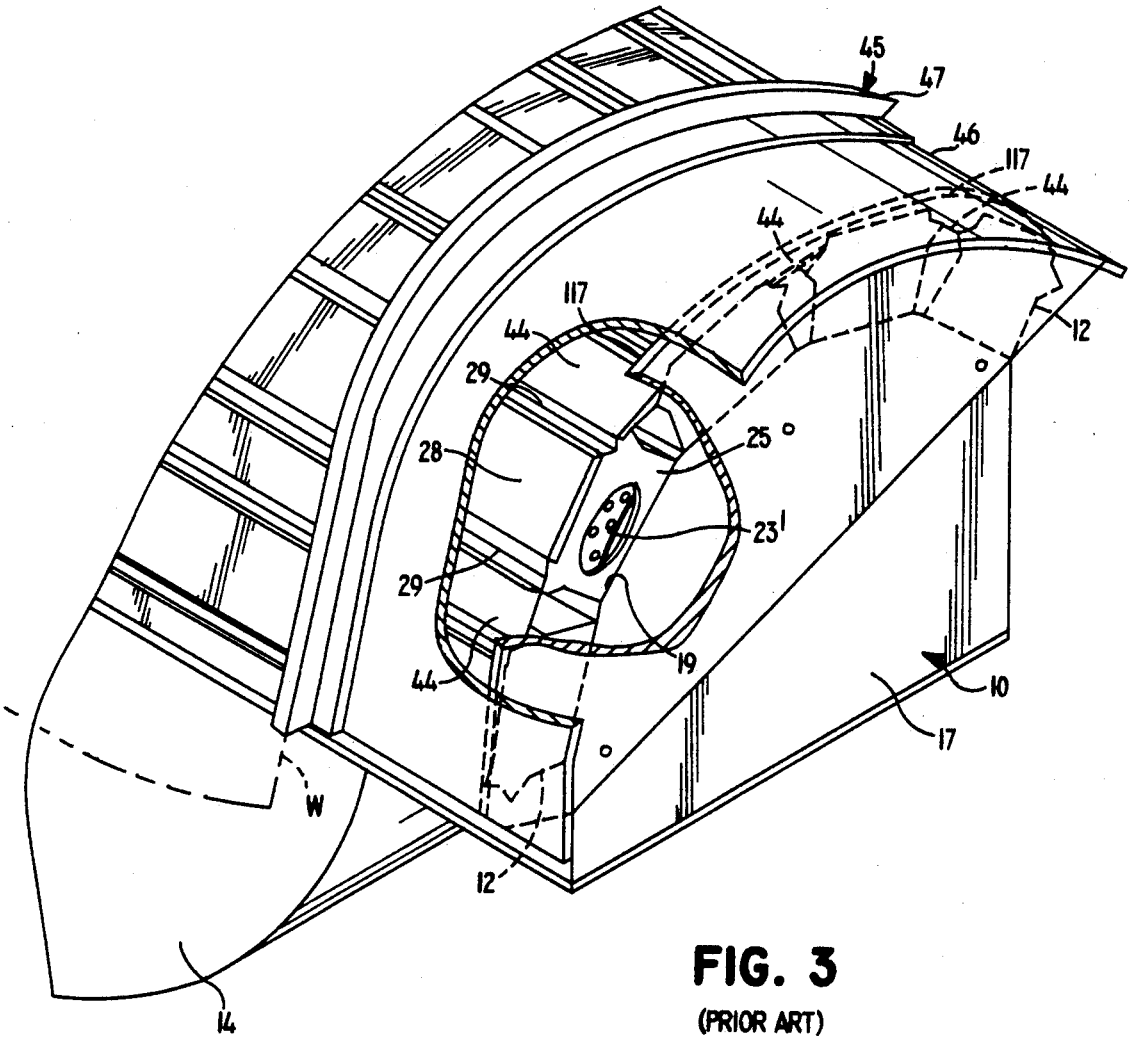
FIG. 3 (PRIOR ART)
FIG. 3 is a fragmentary perspective view of a conventional air turn.

Turning first to FIGS. 1-3, there is shown a conventional air turn of the type disclosed in GB 212697. The air turn 5 guides a lengthwise moving web W around a curve that carries it through a substantial change of direction. The device 5 comprises a plenum chamber 10 and a plurality of elongated air bars 12 which are mounted lengthwise parallel to one another on the front of the plenum chamber to receive pressure air from it and which are shown as having Coanda nozzles 29, described hereinafter, through which the pressure air is discharged. (It should be understood by those skilled in the art that the instant invention is not to be limited to the particular air bars used, the Coanda type air bars being shown for purposes of illustration). The air bars 12 are arranged laterally adjacent to one another in an arc that substantially defines the turn or curve of the web around the device 5, and the air issuing from their nozzles 29 provides an air cushion by which the web is floatingly supported around the turn.

Pressure air is fed into the plenum chamber 10, at its rear, through a suitable duct 14 connected with a pressure air source indicated at 15. It will be understood that when web drying is to be effected at the device 5, the pressure air source 15 will ordinarily comprise a heater.

The plenum chamber 10 is defined by imperforate end walls 17, a rear wall 18 that is imperforate except for the inlet to which the pressure air duct 14 connects, and a front wall 19 that can comprise a single piece of sheet metal bent generally into an arc extending from one to the other of the side edges of the rear wall 18, to thus also define side walls 20. More specifically, the front wall 19 is bent to a partial polygonal shape as seen from either end of the plenum chamber, to have a plurality of flat, substantially identical rectangular panels 22 that meet at obtuse angle corners and on each of which an air bar 12 is mounted. Each flat panel 22 extends lengthwise between the end walls 17 and has a width substantially equal to the width of the air bar mounted thereon. Each panel 22 has numerous uniformly distributed perforations 23 through which pressure air flows from the interior of the plenum chamber 10 into the interior of its air bar 12. These perforations 23 can be formed directly in the front wall 19, or else each panel of the front wall can have a large aperture across which extends a screen or sheet 23 that defines the perforations. In any event, the passage of the pressure air through the 23 brings about a uniform pressure distribution inside the air bar, and the perforations thus serve as a flow straightener.

Suitable air bars 12 include those similar to those disclosed in U.S. Pat. Nos. 3,964,656 and 4,197,971, the disclosures of which are hereby incorporated by reference. Although other types of air bars can be used in the instant invention, such as single slot air bars, double slot Coanda air bars will be discussed herein for purposes of illustration. Each air bar thus comprises a pair of flat end walls 25, a pair of elongated side walls 27 that are mirror images of one another, and a front wall 28 that cooperates with the side walls 27 to define a pair of slot like air discharge outlets 29, each comprising a Coanda nozzle extending along the full length of the air bag. Where standard air bars are used, the end walls 17 of each air bar will lie flatwise inwardly adjacent the respective plenum chamber end walls 17, which project edgewise beyond its front wall 19 as hereinafter explained; or the side walls 27 and front wall 28 of each air bar can extend all the way to the plenum chamber end walls 17, which would then also serve as the air bar end walls. The front wall 28 of each air bar comprises the central portion of a channel member 35 that has a hat-shaped cross section.

Extending along the rear edge of each air bar side wall 27 is laterally inwardly projecting flange 30 that flatwise overlies the plenum chamber panel 22 on which the air bar is mounted, and said flange 30 is secured to its underlying panel as by means of bolts 31. Each air bar side wall 27 is bent along its length, as at 33, to define an outwardly projecting ridge of V-shaped cross section that is near the front edge of the side wall but spaced therefrom. A small laterally inturned lip 34 that extends all along the front edge of each air bar side wall 27 defines the adjacent Coanda nozzle outlet 29 in cooperation with the hat section channel member 35 that comprises the front wall 28. Each of the lips 34 is rearwardly offset by a small distance from the flat, forwardly facing surface of the air bar front wall 28. To cooperate with the lips 34 in defining the Coanda outlets 29, the hat section channel member 35 has opposite rearwardly projecting legs 36, each joined to the front wall 28 at a rounded corner 37 and from each of which a flange 38 projects laterally outwardly to be received in the groove defined by the V-shaped bend 33 in the adjacent air bar side wall. The outer edge of each flange 38 is spot welded to the adjacent air bar side wall 27 at intervals along its length.

Holes 39 in each flange 38, at closely spaced intervals along it, permit pressure air from the interior of the air bar to flow through the flange 38, thence through the space between the adjacent leg 36 of the channel member and its adjacent air bar side wall 27, and out through the nozzle slot 29. The lip 34, in conjunction with the rounded surface 37, has the well known function of causing the air stream issuing from the slot 29 to flow away from the nozzle in an oblique direction, laterally inwardly across the air bar front wall 28 as well as forwardly towards the web. Upon impinging the web, the stream issuing from each nozzle 29 divides, part of it flowing laterally inwardly under the web in converging relation to a stream component from the other air outlet 29 of the air bar, and another part flowing laterally away from the air bar.

In some cases it may be desirable to provide outlet openings 41 in the air bar front wall 28, at regular intervals all along its length and midway between the outlet slots 29, through which the air streams that converge across the front wall 28 can flow into a tubular exhaust chamber 42 in the front portion of the air bar, all as shown in FIG. 1. In such cases the exhaust chamber 42 is defined by a plate 43 that bridges the rearwardly extending legs 36 of the channel member in cooperation with those legs and the front wall 28; and the end walls 25 of the air bar have openings through which the tubular exhaust chamber 42 communicates with the atmosphere at both of its ends. The outlet openings 41, their associated exhaust chamber 42 and its venting outlet will of course tend to increase the flow of air in contact with the web and they may be particularly desirable where the device 5 is relied upon to effect significant web drying. The holes 41 have been found to be unnecessary where the device is intended to function solely or primarily as a turning guide, and where the holes 41 are omitted or are not utilized, the plate 43 can be omitted from each air bar or replaced by brace struts, and the end walls 25 of the air bar will completely close its ends.

The flat front walls 28 of the air bars lie substantially on an arc of constant radius that defines the path of the web as it moves around the device 5. The angle between the front walls 28 of adjacent air bars is related to this radius of web curvature, and should of course be uniform from air bar to air bar around the assembly. Successful results have been achieved with web tensions from about 0.5 to 2.0 pounds per linear inch (0.04 to 0.17 kg/mm) when the angle between front walls 28 of adjacent air bars was in the range of about 20° to about 30°, with a web turn radius of about 9 to 12 inches (230–360 mm). With these parameters, the web did not contact the device even with changes in the amount of wrap about the device 5 that correspond to swinging of stretches 8 and 9 through angles of up to approximately 10° about the device 5.

Because adjacent air bars are at an angle to one another, there are gaps between them, but these are filled by plates 44, each of which bridges across the space between a pair of adjacent air bars and extends along their full length. Preferably each plate 44 rests on, and is tack-welded to, the ridges (defined by bends 33) on the adjacent side walls 27 of the air bars that it bridges. The several plates 44 are thus disposed substantially on an arc which is of smaller radius than, but concentric with, the arc that substantially contains the front walls 28 of the several air bars.

A portion of the air stream issuing from each outlet slot 29 turns laterally away from the air bar after impinging on the web, and thus flows into the space between the web and a plate 44. Each of the end walls 17 of the plenum chamber has its front edge curved to the arc upon which the front wall 28 of the air bars are substantially located so that the radially outermost portions of the plenum end wall serve as fixed air dams 117 that project forward from the filler plates 44 and restrain air flow lengthwise outwardly along them. For convenience, in manufacture, the air dams 117 can comprise portions of a separate plate 17' that is secured to each plenum chamber end wall 17, flatwise outwardly overlying it as best seen in FIG. 3. Each filler plate 44 thus cooperates with the fixed air dams 117 to maintain an air cushion in the space in front of the plate, so that the web is maintained at a uniform curvature all around the device.

If the gaps between air bars are left open by omission of the filler plates 44, the web tends to have straight, flat stretches between adjacent air bars, and thus tends to drag on the air bars, unless substantially higher air pressure values are used than are needed with the plates 44 installed. Thus, the plates 44 may be omitted in cases where a relatively high air flow in contact with the web is desired for web drying and where the need for higher air pressure is acceptable. On the other hand, moving the plates 44 forwardly from the positions shown, so that they are more nearly at the same radius as the front walls 28 of the air bars, tends to reduce the pressure needed to maintain a smooth curvature of the web around the device and correspondingly reduces the rate of flow of air in contact with the web.

Figure 15:
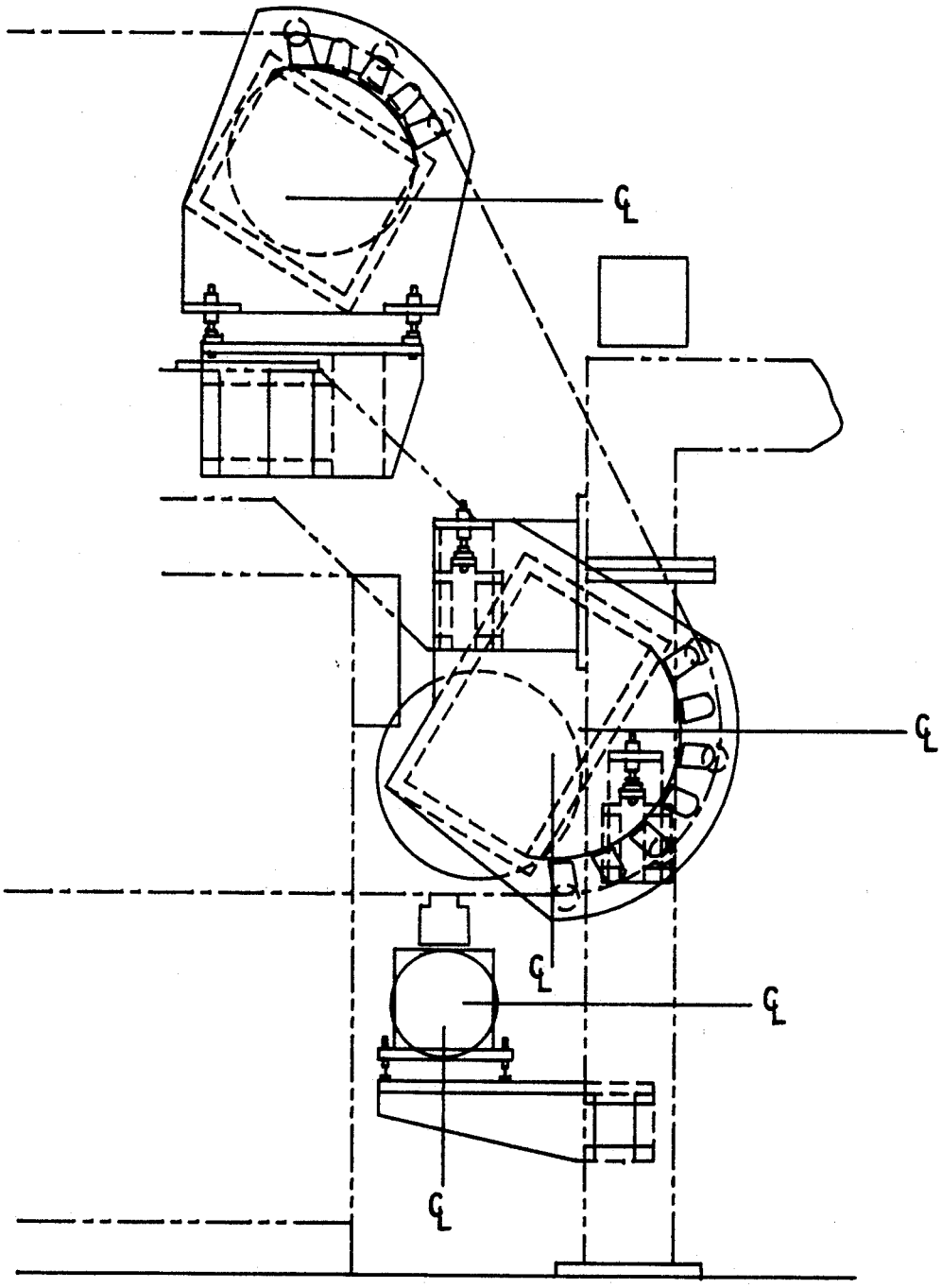
FIG. 15 is a diagrammatic view of a plurality of air turns arranged in an array.

Air turns such as device 5 are often used in arrays, such as is shown in FIG. 15, to contactlessly support and turn the web in order to provide the desired web path between other process equipment such as coaters and flotation dryers. The inventors of the present invention have found that web flutter occurring, for example, as the web moves from a lower air turn to an upper air turn in an air turn array can be reduced or eliminated by introducing a wing type foil or trailing sheet assembly on the air turn.

Figure 4:
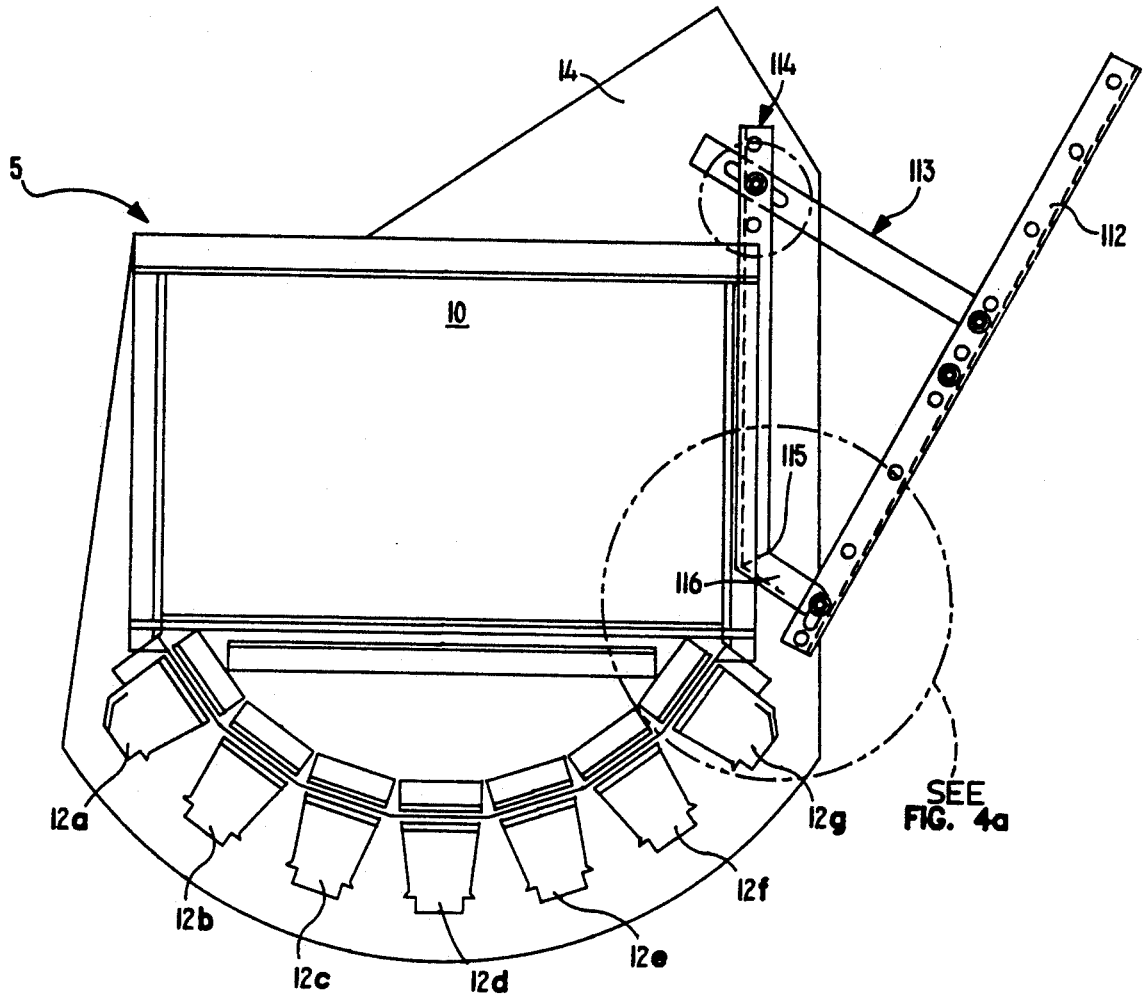
FIG. 4 is a section view of an air turn including a trailing sheet assembly in accordance with the instant invention.

Turning now to FIG. 4, there is shown an air turn 5 having a plurality of air bars **12*a*–12*g* in air-receiving communication with a suitable duct 14. The air bars 12*a*–12*g*** are arranged in a arcuate fashion and function to contactlessly support and optionally dry a web of material passing thereover. Suitable air bars are of the Coanda type, preferably HI-FLOAT® air bars available commercially from W.R. Grace & Co.-Conn., or single slot air bars, also available from W.R. Grace & Co.-Conn. Those skilled in the art will appreciate that the particular air bars used will depend upon the desired application.

Figure 4A:
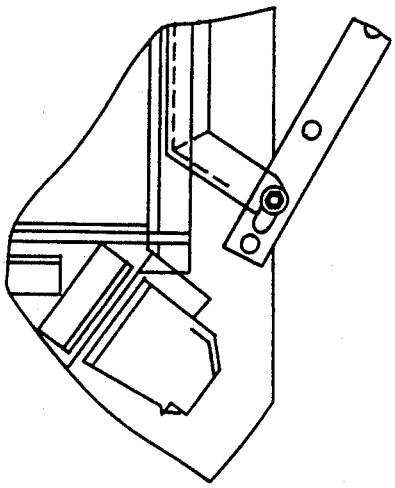
FIG. 4*a* is an enlarged view of the trailing sheet assembly in proximity of an air bar.
Figure 12:
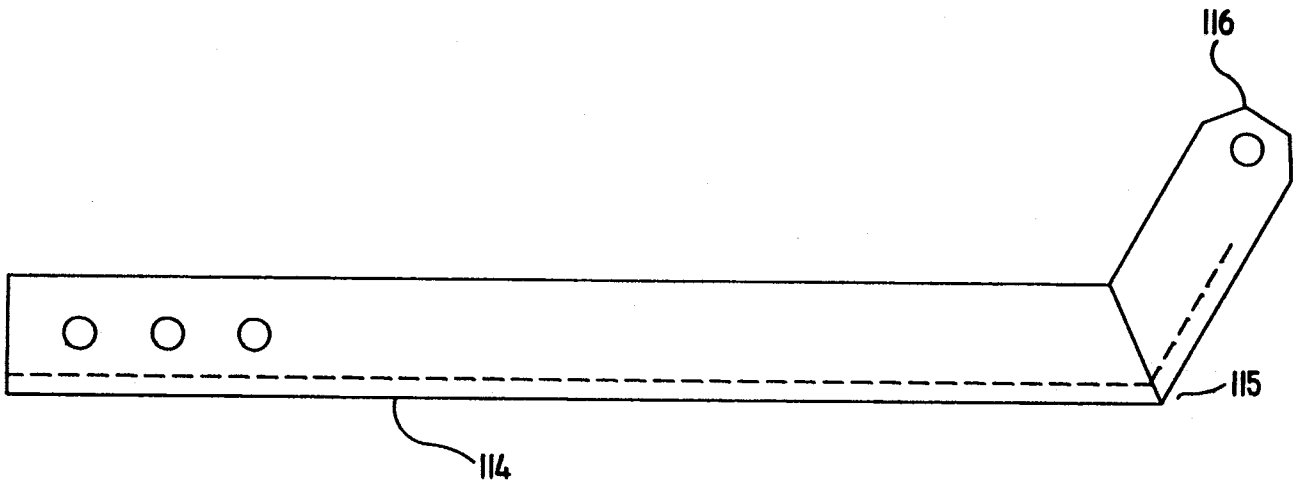
FIG. 12 is a top view of the angled frame support.
Figure 13:
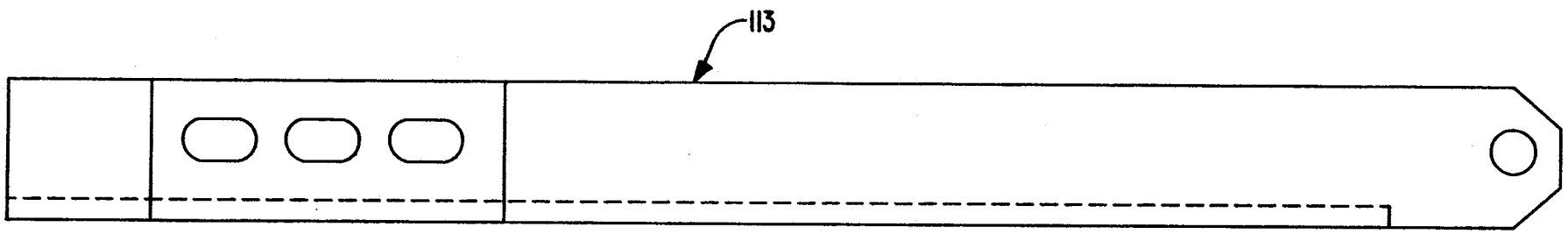
FIG. 13 is a top view of the straight frame support.

As shown in FIG. 4, an elongated wing or trailing sheet assembly 112 is used in conjunction with the web exit side air bar **12*g*, and its position with respect thereto is adjustable by virtue of the adjustable frame members 113, 114. The trailing sheet assembly 112 directs the spent air cushion from the air bars in the web direction. The trailing sheet assembly 112 is mounted on an adjustable frame (FIGS. 14 and 14*a*) and is affixed to the air turn with adjustable straight frame support 113 and adjustable angled frame support 114 as shown. Frame support 114 is attached to device 5 such as at plenum 10 or header 14 by any suitable means, preferably by tack welding. Frame support 113 can be coupled to frame support 114 (FIG. 4*a*) such as with a screw and nut assembly, and suitable lock washers. As shown in FIGS. 4 and 12, frame support 114 is angled at 115 so as to define an extension portion 116 for coupling the trailing sheet 112 to the frame. The extension 116 extends outward of the plenum 10. An angle of 60° at 115 is preferred. Preferably a plurality of holes are provided for coupling the frame support 114 to straight frame support 113, the operative hole depending upon the angle desired for the trailing sheet. Straight frame support 113 (FIG. 13) is coupled at one end to frame support 114 and at the other end to the trailing sheet 112. A plurality of slots are provided at the end for coupling to frame support 114, the operative slot again depending upon the angle desired for the trailing sheet assembly 112**. A second similar frame support mechanism can be used at the opposite end of the trailing sheet assembly to secure the assembly to the air turn.

Figure 14:
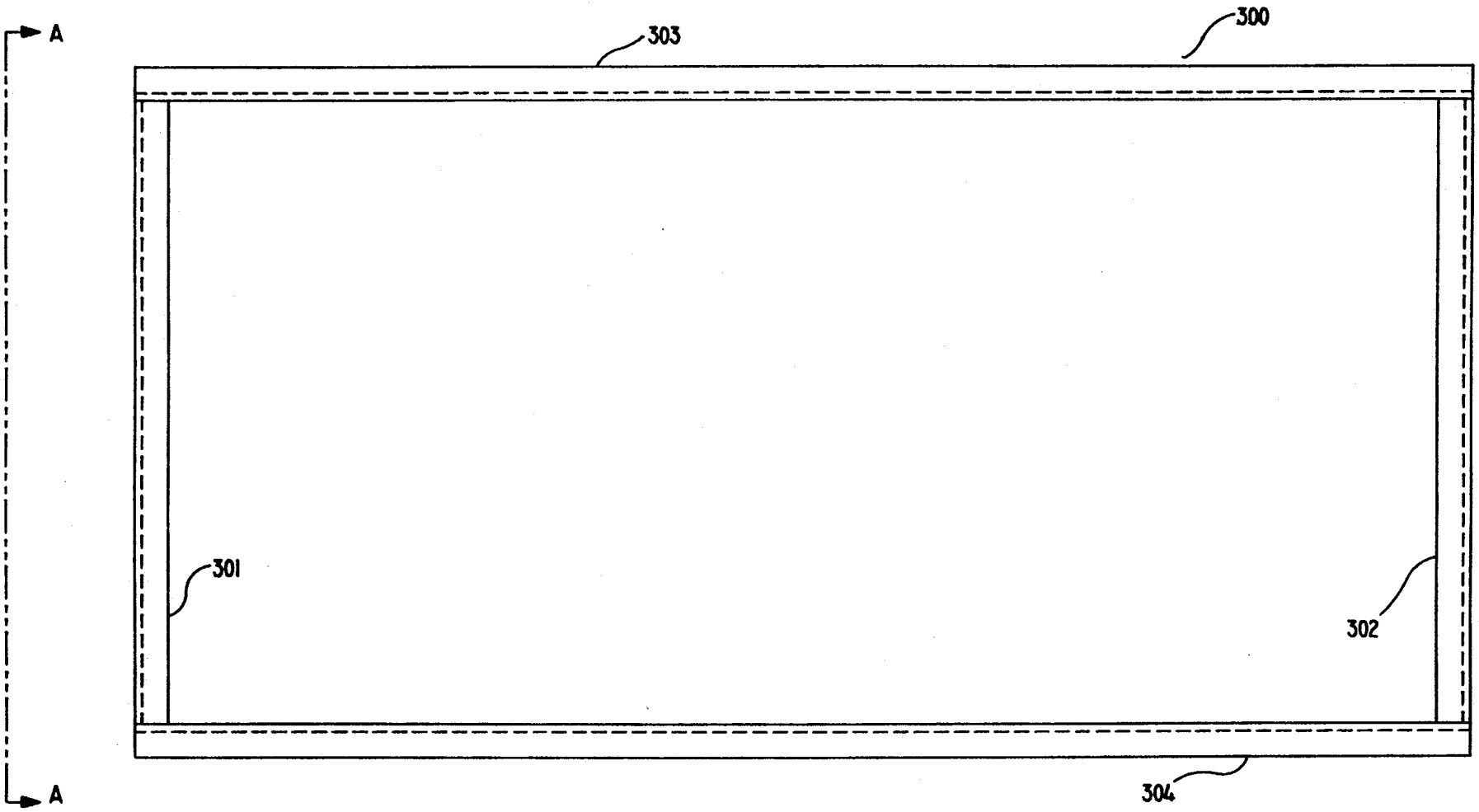
FIG. 14 is a top view of the adjustable frame for the trailing sheet assembly.
Figure 14A:
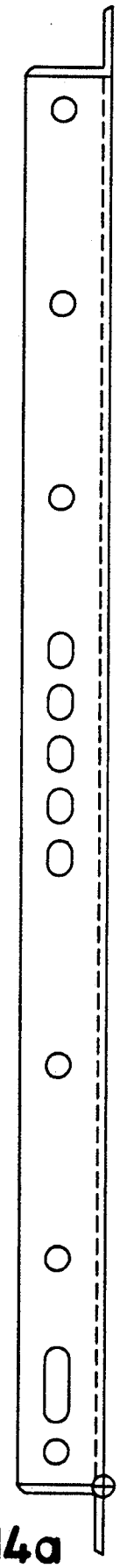
FIGS. 14*a* and 14*b* are side views of the adjustable frame for the trailing sheet assembly.
Figure 14B:
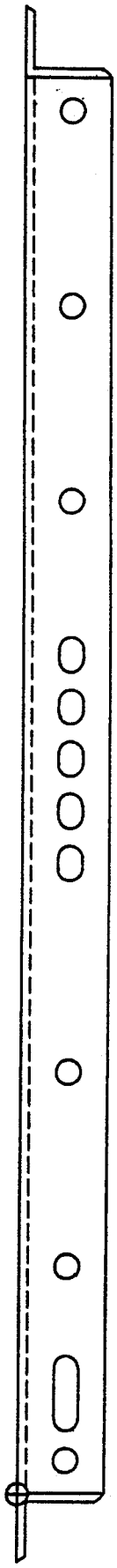

Preferably the trailing sheet assembly is positioned such that it is at a 2°–3° angle with respect to the tangent to the surface of last air bag **12*g*, most preferably 2.39°. As shown in FIGS. 14, 14*a* and 14*b*, the trailing sheet assembly 112 is mounted on an adjustable frame 300, shown in FIGS. 14, 14*a* and 14*b*. The frame 300 includes a pair of vertical members 301, 302 and a pair of horizontal members 303, 304. A plurality of slots or holes are provided (FIGS. 14*a* and 14*b*) in vertical members 301, 302 for adjustable mounting with frame supports 113, 114**.

Figure 5:
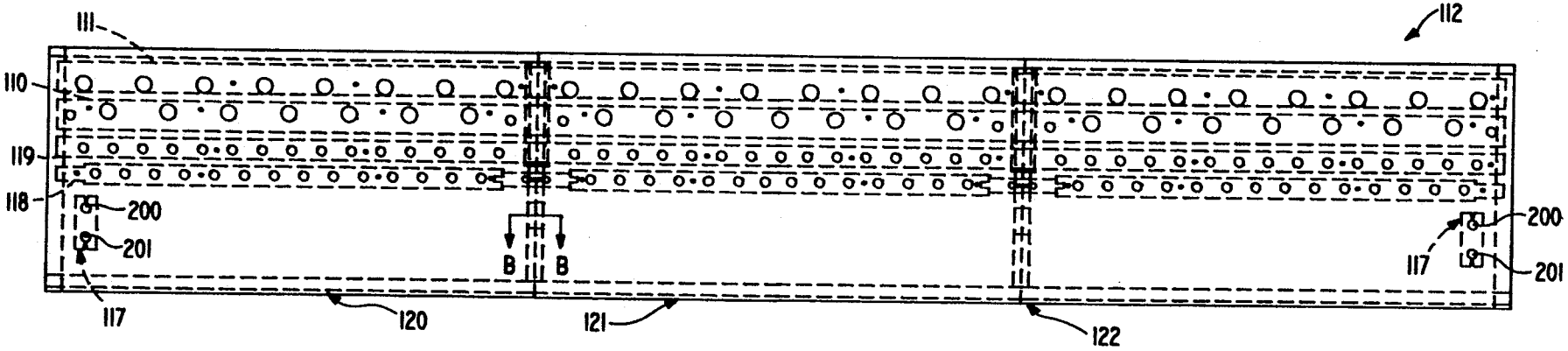
FIG. 5 is a view of the trailing sheet assembly taken along line A—A of FIG. 4.

Turning to FIG. 5, trailing sheet assembly 112 is shown with a plurality of adjustable relief holes which will be discussed in more detail below. Trailing sheet assembly 112 includes a trailing sheet tending side 120 coupled to a trailing sheet center 121 by any suitable means, such as by nut and bolt, which in turn is similarly coupled to a trailing sheet gear side 122. In one embodiment of the present invention, the trailing sheet assembly is 48 inches high and 273 inches long, the tending side, center and gear side each being 91 inches long. The particular length of the trailing sheet assembly depends on the radius of the air turn to which it is attached. Preferably, the length of the trailing sheet assembly is about 130–190% of the air turn radius. For the above embodiment, the radius of the air turn was 26 inches.

Figure 5A:
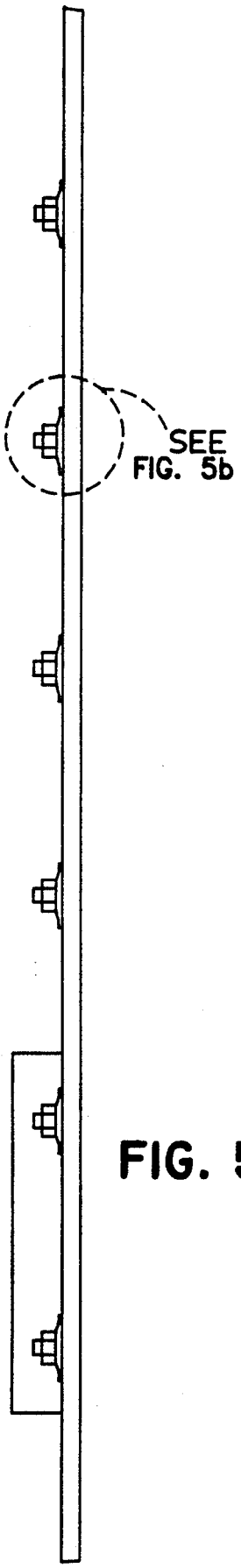
FIG. 5*a* is a side view of the trailing sheet assembly of FIG. 5.
Figure 5B:
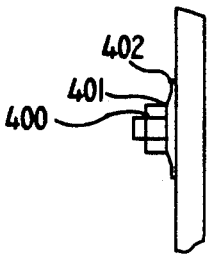
FIG. 5*b* is a view of the trailing sheet assembly of FIG. 5 taken along line B—B.
Figure 6:
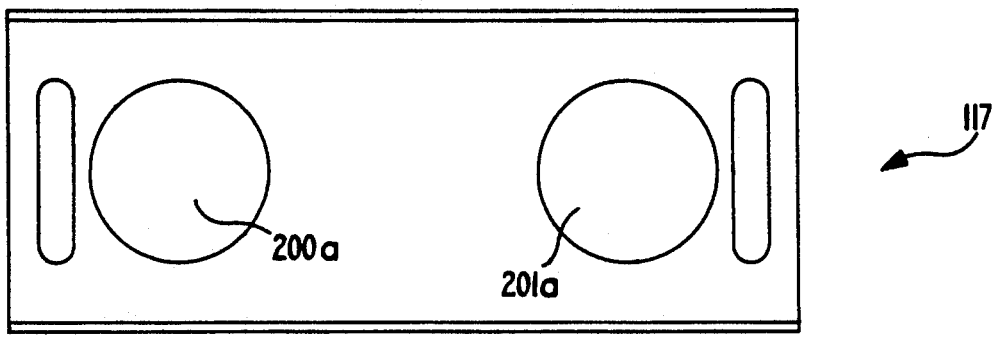
FIG. 6 is a top view of a first C-shaped adjustable air flow channel.
Figure 6A:
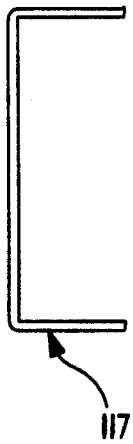
FIG. 6*a* is a side view of the first C-shaped adjustable air flow channel.

Different size C-shaped adjustable airflow channels 117, 118, 119, 110 and 111 are mounted with suitable fastening means (nut 400, washers 401 and 402 shown) on studs (FIGS. 5*a* and 5*b*) provided on each of the rear sides of trailing sheet assembly tending side 120, center 121 and gear side 122 for adjusting the airflow through the assembly 112. In particular, FIG. 6 shows adjustable airflow channel 117 having a pair of 2 inch diameter holes 200*a*, 201*a* positioned to correspond to holes 200 and 201 on trailing sheet tending side 120 and gear side 122. A pair of slots 0.5 inches by 2 inches are located at each end of channel 117 for mounting on the studs of assembly 112. If total air flow is desired through holes 200, 201 in the assembly 112, the channel 117 is mounted so that holes 200*a*, 201*a* are directly over holes 200, 201. Similarly, if partial or no air flow is desired through holes 200, 201 in assembly 112, channel 117 is mounted so that holes 200*a*, 201*a* are not directly over holes 200, 201 to thereby restrict air flow. In the embodiment where the trailing sheet assembly 112 is 48"×273", the channel 117 is 4 inches wide by 10.25 inches long.

Figure 7:
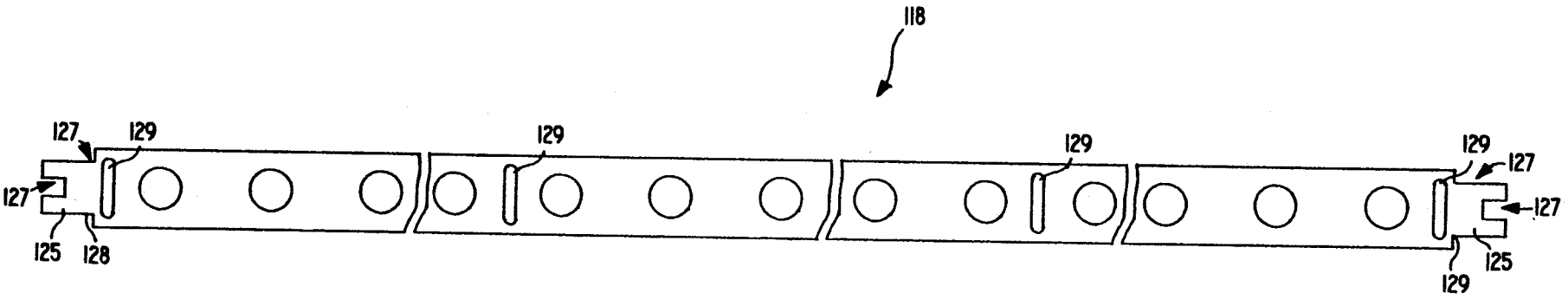
FIG. 7 is a top view of a second C-shaped adjustable air flow channel.

FIG. 7 shows adjustable channel 118, which in the embodiment where the trailing sheet assembly 112 is 48"×273", is 4 inches wide by 86.12 inches long. Each end portion 125 includes an extension which is narrower than the remainder of the channel 118 at shoulders 127, 128. Each end portion 125 also includes a mounting detent 127 for adjustable mounting of the channel on the sheet assembly 112. A plurality of other mounting slots 129 are spaced through the length of the channel member 118. Channel member 118 includes a plurality of holes along its length, which correspond in size and space to the holes over which it is mounted in trailing sheet assembly 112, in order to allow or restrict air flow therethrough as discussed above with respect to channel member 117.

Figure 8:
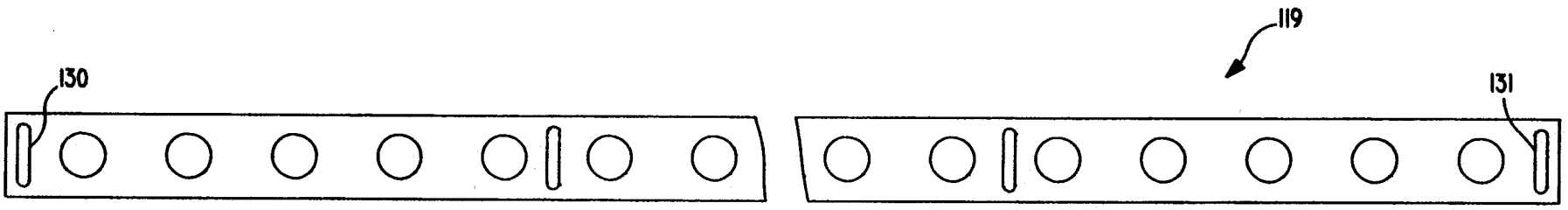
FIG. 8 is a top view of a third C-shaped adjustable air flow channel.

FIG. 8 shows adjustable channel member 119, which in the embodiment where the trailing sheet assembly 112 is 48"×273", is 4 inches wide by 86.31 inches long. The channel member 119 includes a plurality of mounting slots spaced along its length, with slots 130 and 131 at the ends of the channel member, and the remainder of slots spaced accordingly. Channel member 119 includes a plurality of holes along its length, which correspond in size and space to the holes over which it is mounted in trailing sheet assembly 112, in order to allow or restrict air flow therethrough as discussed above with respect to channel member 117.

Figure 9:
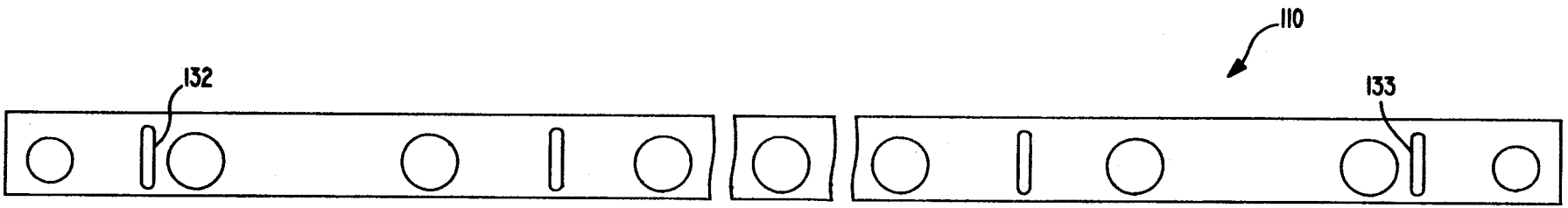
FIG. 9 is a top view of a fourth C-shaped adjustable air flow channel.

FIG. 9 shows adjustable channel member 110, which in the embodiment where the trailing sheet assembly 112 is 48"×273", is 5 inches long. The channel member 110 includes a plurality of mounting slots spaced along its length, with slots 132 and 133 near the ends of the channel member, and the remainder of slots spaced accordingly. Channel member 110 includes a plurality of holes along its length, which correspond in size and space to the holes over which it is mounted in trailing sheet assembly 112, in order to allow or restrict air flow therethrough as discussed above with respect to channel member 117.

Figure 10:
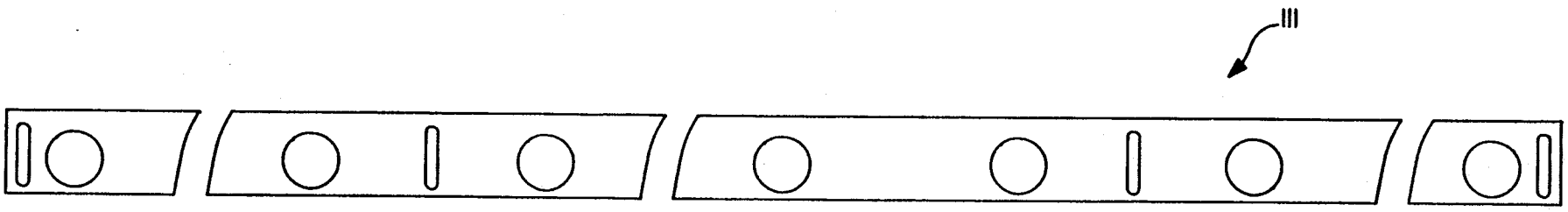
FIG. 10 is a top view of a fifth C-shaped adjustable air flow channel.

FIG. 10 shows adjustable channel member 111, which in the embodiment where the trailing sheet assembly 112 is 48"×273", is 5 inches wide by 85.62 inches long. The channel member 111 includes a plurality of mounting slots spaced along its length, with slots 134 and 135 at the ends of the channel member, and the remainder of slots spaced accordingly. Channel member 111 includes a plurality of holes along its length, which correspond in size and space to the holes over which it is mounted in trailing sheet assembly 112, in order to allow or restrict air flow therethrough as discussed above with respect to channel member 117.

Figure 11:
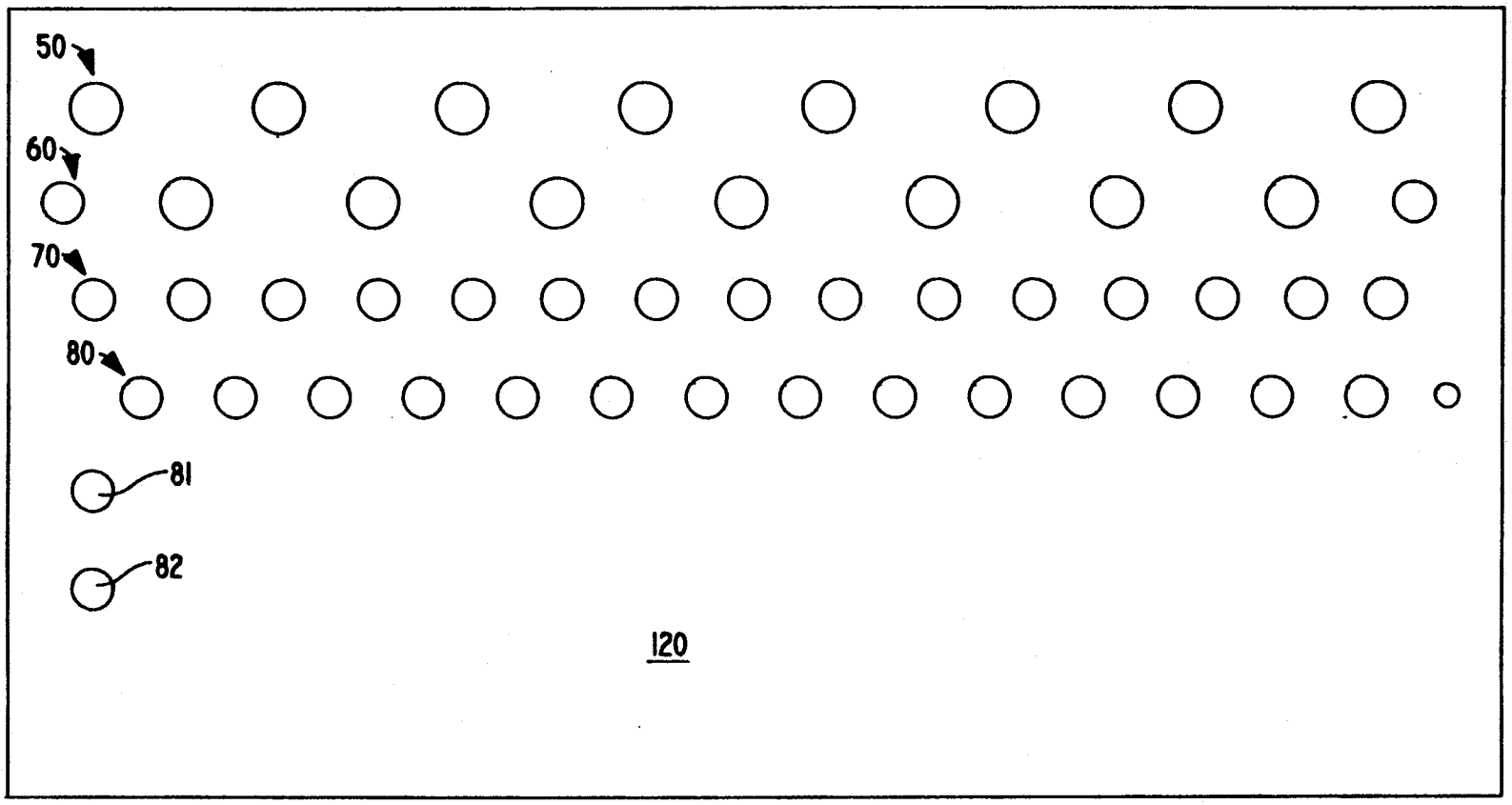
FIG. 11 is a view of one hole pattern on the tending side of the trailing sheet assembly.

A suitable hole pattern on the trailing sheet assembly is illustrated with reference to the trailing sheet tending side 120 in FIG. 11. A top row 50 of eight 3 inch diameter holes are provided, the centers of each being spaced 11.37 inches apart and six inches from the top of the sheet. The left and right most holes are spaced 5.69 inches from the respective edges of the sheet.

A second row of holes 60 includes seven 3 inch diameter holes equally spaced between a pair of 2 inch diameter holes. The second row of holes is formed such that the centers thereof are 12 inches from the top of the sheet. The 3 inch hole centers are spaced 11.38 inches apart. The 2 inch holes are each 3.81 inches from its respective sheet edge.

A third row of holes 70 includes fifteen two inch holes with centers formed 18 inches from the top of the sheet. Each hole center is 5.69 inches apart, and the centers of the left and right most holes are 5.69 inches from the respective sheet edge.

A fourth row of holes 80 includes fourteen 2 inch holes and one 1 inch hole 24 inches from the top of the sheet. The centers of each hole are spaced 5.69 inches apart, with the centers of the left and right most holes being 8.53 inches from the respective sheet edge. The 1 inch hole is 2.84 inches from the right sheet edge.

A two inch diameter hole 81 is formed 30 inches from the sheet top and 5.69 inches from the left sheet edge. A two inch diameter hole is 82 also formed 36 inches from the sheet top and 5.69 inches from the left sheet edge.

The gear side 122 of the trailing sheet assembly 112 has a hole pattern that is the mirror image of the hole pattern of the tending side 120. The hole pattern of the center 121 of trailing sheet assembly 112 is the same as that for the tending side 120, except center 121 does not include the two inch diameter hole formed 30 inches from the sheet top or the two inch diameter hole formed 36 inches from the sheet top, and does include an additional 1 inch diameter hole symmetrically spaced at the left side of the fourth row of holes.

The trailing sheet assembly 112 is designed to reduce or eliminate web flutter when the web leaves the air turn. The trailing sheet assembly 112 directs the spent air cushion from the air bars in the web direction. The adjustable relief holes in the assembly allow for a controlled dispersement of the spent cushion air which, in turn, reduces or eliminates the air vortex and the web flutter. Based upon the particular behavior of the web under consideration, those skilled in the art will be able to adjust the air flow to achieve maximum performance.

What is claimed is:

1. In an air turn for floatingly supporting a running web, said air turn comprising a plurality of air bars mounted in a substantially convex arc, including a web entry air bar and a web exit air bar, said plurality of air bars being in air receiving communication with a plenum chamber, said plenum chamber being in communication with an air source, means for reducing web flutter as said web exits said air turn, comprising a trailing sheet assembly mounted in proximity to said web exit air bar such that said sheet assembly is at about a 2°-3° angle with respect to the tangent of the surface of said web exit air bar, so as to direct the spent air cushion from said plurality of air bars in the direction of said running web.

2. The air turn of claim 1, wherein said trailing sheet assembly comprises a plurality of relief holes for allowing air to flow through said trailing sheet assembly.

3. The air turn of claim 2, wherein the amount of air flow flowing through said trailing sheet assembly is adjustable.

4. The air turn of claim 3, wherein said air flow is adjustable by varying the amount of air flowing through said relief holes.

5. The air turn of claim 1, wherein the length of said trailing sheet assembly is 130–190% of the air turn radius.

* * * * *